US007073454B2

(12) United States Patent
Katsuyama et al.

(10) Patent No.: US 7,073,454 B2
(45) Date of Patent: Jul. 11, 2006

(54) SEWING MACHINE

(75) Inventors: Masayuki Katsuyama, Toyota (JP); Hitoshi Ishikawa, Nishio (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/258,845

(22) Filed: Oct. 27, 2005

(65) Prior Publication Data

US 2006/0107884 A1 May 25, 2006

(30) Foreign Application Priority Data

Nov. 15, 2004 (JP) ..... 2004-330936

(51) Int. Cl.
*D05B 73/10* (2006.01)

(52) U.S. Cl. ..... 112/260

(58) Field of Classification Search ..... 112/258, 112/259, 260, 217.1, 217.2; 312/208.5, 208.6, 312/215, 351.1; 108/17, 56.3, 64, 90, 92, 108/93

See application file for complete search history.

(56) References Cited

U.S. PATENT DOCUMENTS

| | | | | |
|---|---|---|---|---|
| 3,013,514 | A * | 12/1961 | Stanton | 112/260 |
| 3,673,972 | A * | 7/1972 | Grange | 112/258 |
| 3,677,210 | A | 7/1972 | Perlino | |
| 4,040,369 | A * | 8/1977 | Kaito | 112/258 |
| 4,114,548 | A * | 9/1978 | Kasahara et al. | 112/258 |
| 4,220,103 | A | 9/1980 | Kasahara et al. | |
| 4,421,043 | A | 12/1983 | Kornatowski et al. | |
| 4,458,615 | A | 7/1984 | Adams | |
| 5,343,821 | A * | 9/1994 | Tseng | 112/258 |
| 5,476,052 | A * | 12/1995 | Kojima et al. | 112/260 |
| 5,531,172 | A * | 7/1996 | Kojima et al. | 112/260 |

FOREIGN PATENT DOCUMENTS

| | | |
|---|---|---|
| JP | 6-7572 | 1/1994 |
| JP | 3021041 U | 11/1995 |
| JP | 10-201981 | 8/1998 |
| JP | 2002-28391 | 1/2002 |

* cited by examiner

*Primary Examiner*—Ismael Izaguirre
(74) *Attorney, Agent, or Firm*—Oblon, Spivak, McClelland, Maier & Neustadt, P.C.

(57) ABSTRACT

A sewing machine includes a sewing machine body, a free arm portion extending from the sewing machine body, and an auxiliary bed detachably mounted on the free arm portion to allow the sewing machine to operate, the auxiliary bed being brought into engagement with the free arm portion to be in flush with the free arm portion.

14 Claims, 6 Drawing Sheets

SEWING MACHINE

This application is on the basis of and claims priority under 35 U.S.C. § 119 to Japanese Patent Application 2004-330936, filed on Nov. 15, 2004, the entire content of which is incorporated herein by reference.

FIELD OF THE INVENTION

This invention relates to a sewing machine. More particularly, this invention pertains to a sewing machine, in which, when an auxiliary bed is mounted on a free arm portion, the auxiliary bed and the free arm portion cooperate to form a flat bed portion.

BACKGROUND

A known sewing machine of the type is disclosed in, say, JP3021041U. In this sewing machine, mounting an auxiliary table on a free arm forms a flat bed portion.

However, in the aforementioned sewing machine, the auxiliary table to be mounted on the free arm has fixed dimensions, which results in that a working space of the flat bed portion is too small or large, for a specific workpiece, to make a user's operation for sewing the workpiece inconvenient.

A need thus exists to provide a sewing machine that has variable dimensions of a working space of a flat bed portion that is formed when an auxiliary table is mounted on a free arm.

SUMMARY OF THE INVENTION

According to an aspect of the present invention, a sewing machine includes a sewing machine body, a free arm portion extending from the sewing machine body, and an auxiliary bed detachably mounted on the free arm portion to allow the sewing machine to operate, the auxiliary bed being brought into engagement with the free arm portion to be in flush with the free arm portion.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be explained with reference to illustrations of drawing figures as follows.

Figure 1:
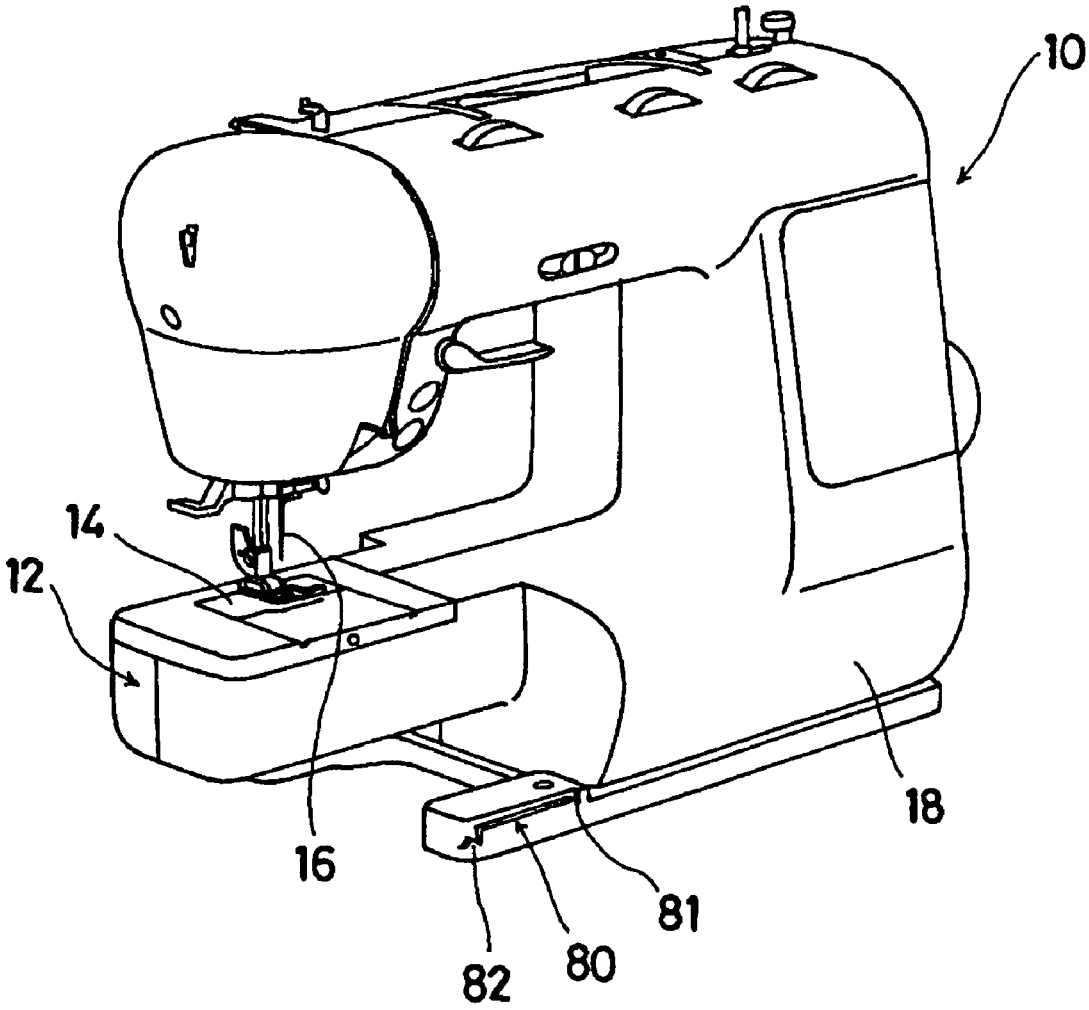
FIG. 1 is a perspective view illustrating a sewing machine according to an embodiment of the present invention in a condition where the sewing machine is used as a free arm type.

As illustrated in FIG. 1, a sewing machine 10 according to the embodiment of the present invention includes a bed free arm portion 12, which extends from a sewing machine body 18, a throat plate 14, which is at a distal end portion of an upper surface of the free arm portion 12, and a sewing mechanism (not shown), which is placed in the free arm portion 12 so as to be positioned underneath the throat plate 14. The sewing machine 10 further includes a needle 16, which reciprocates up-and-down. Whenever the needle 16 passes through the throat plate 14, the sewing mechanism cooperates with the needle 16 to stitch a workpiece (e.g., cylindrical workpiece) that has been fitted on the free arm portion 12.

Figure 2:
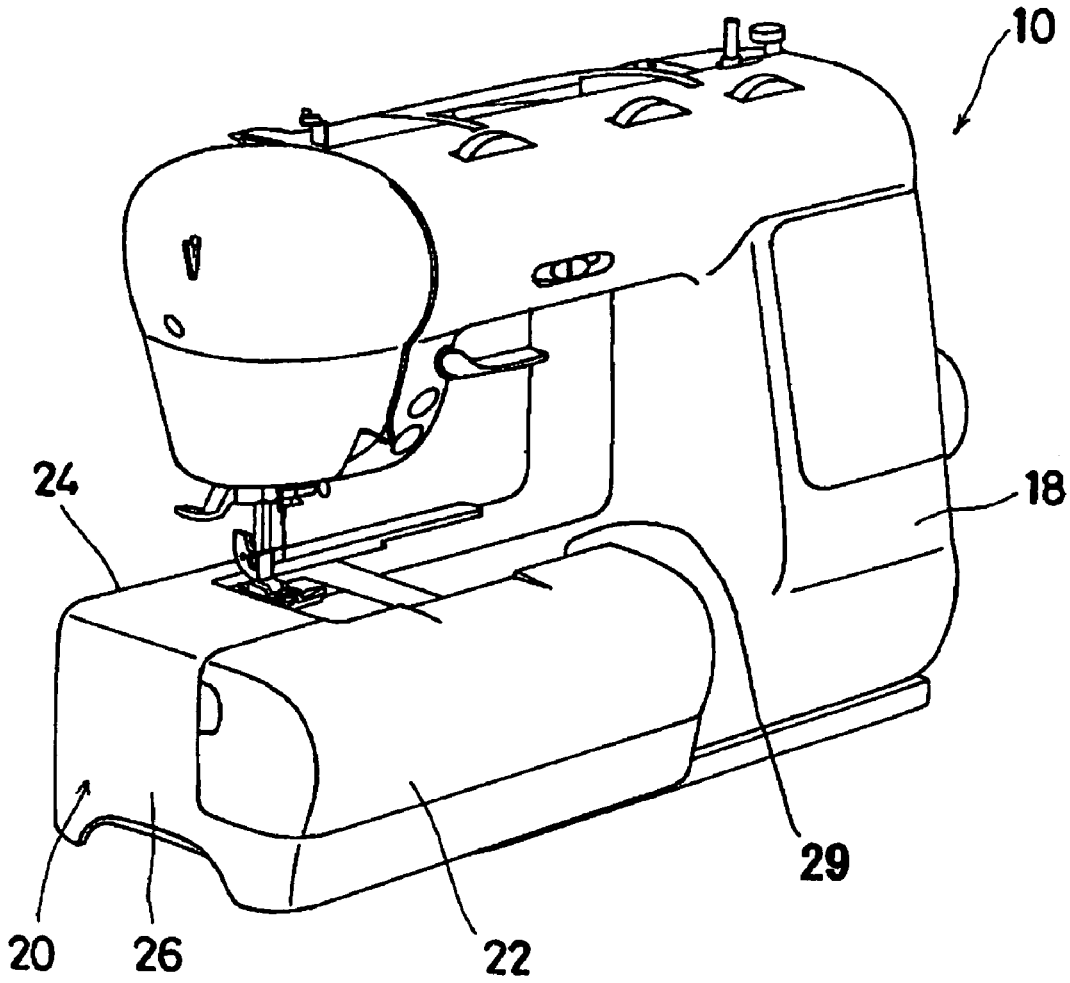
FIG. 2 is a perspective view illustrating a condition in which the sewing machine shown in FIG. 1 provided with an auxiliary bed to form a flat bed having a first working space.
Figure 3:
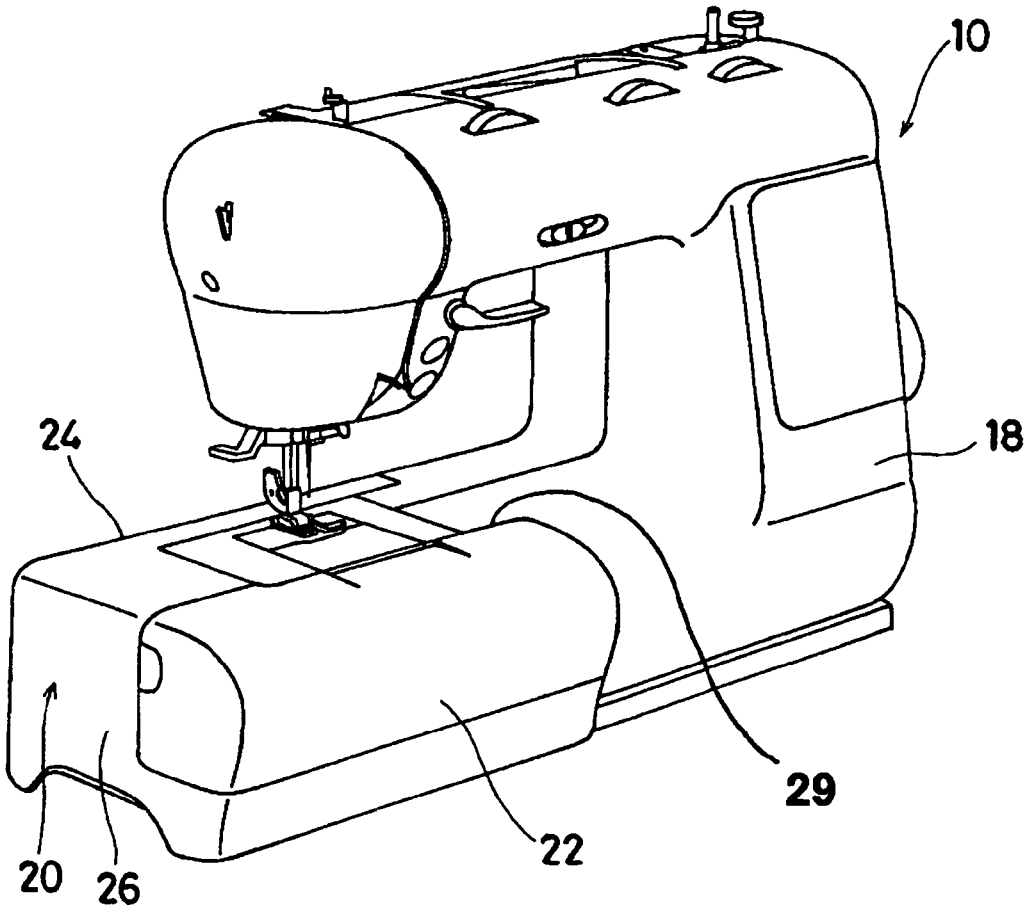
FIG. 3 is a perspective view illustrating a condition in which the auxiliary bed is moved through a predetermined distance from the free arm of the FIG. 2—shown sewing machine.
Figure 4:
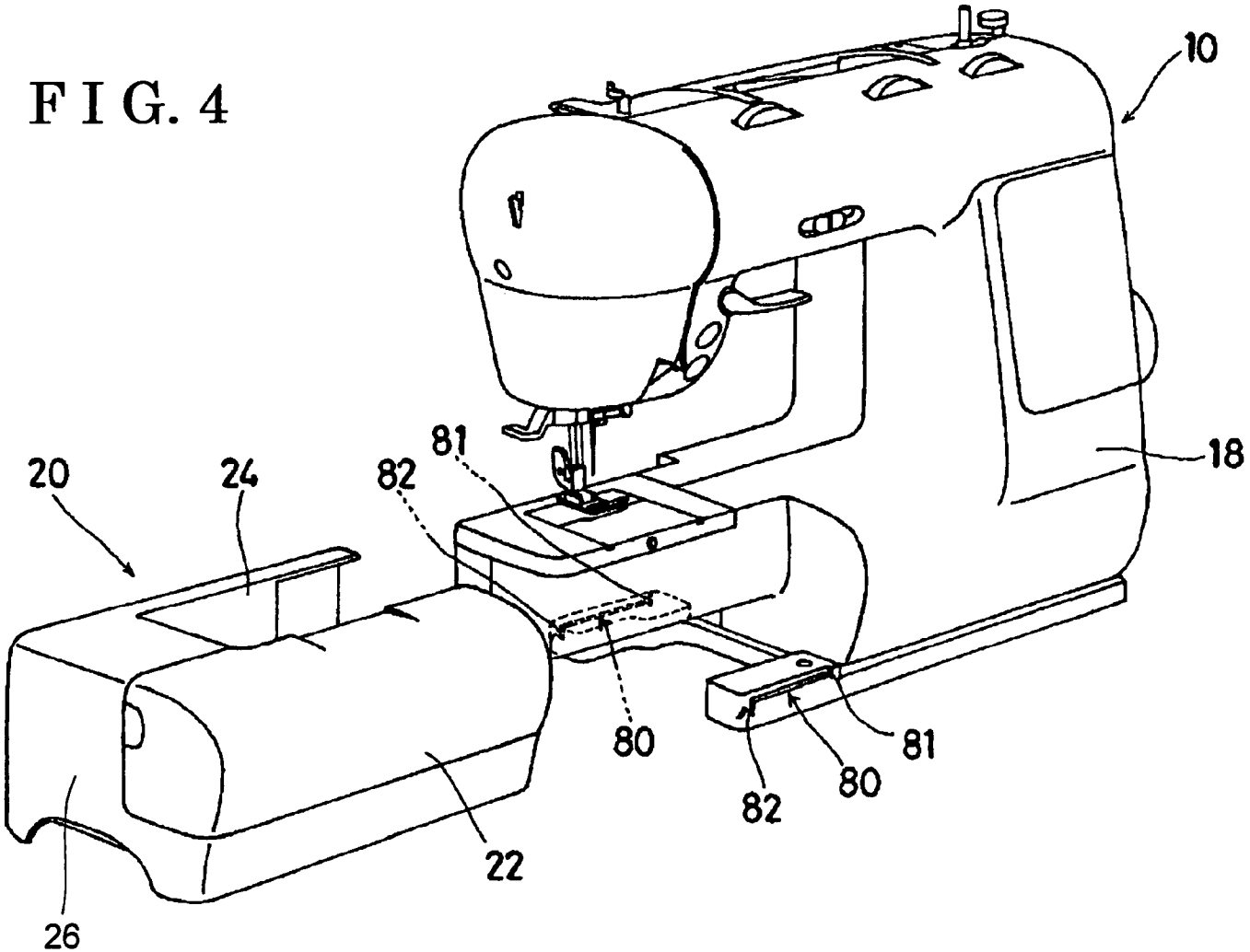
FIG. 4 is a perspective view illustrating a condition in which the auxiliary bed of the sewing machine shown in FIG. 2 has been completely pulled away from the free arm.
Figure 5:
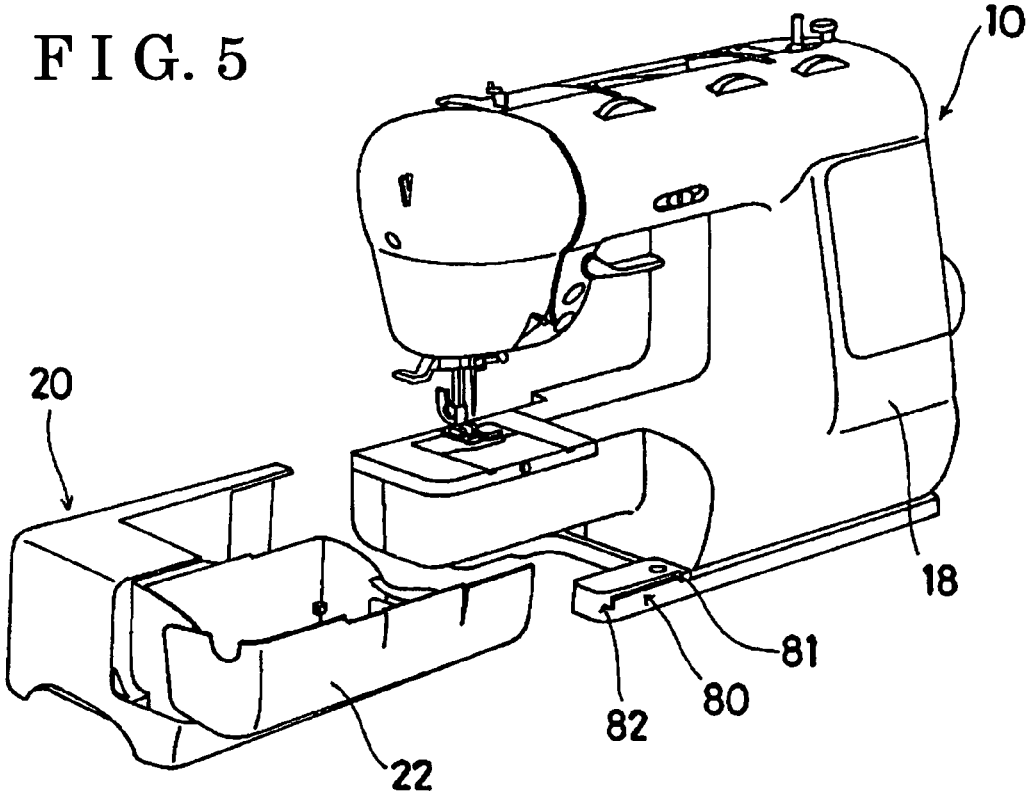
FIG. 5 is a perspective view illustrating a condition in which a front portion of the auxiliary bed of the sewing machine shown in FIG. 4 has been opened.
Figure 6:
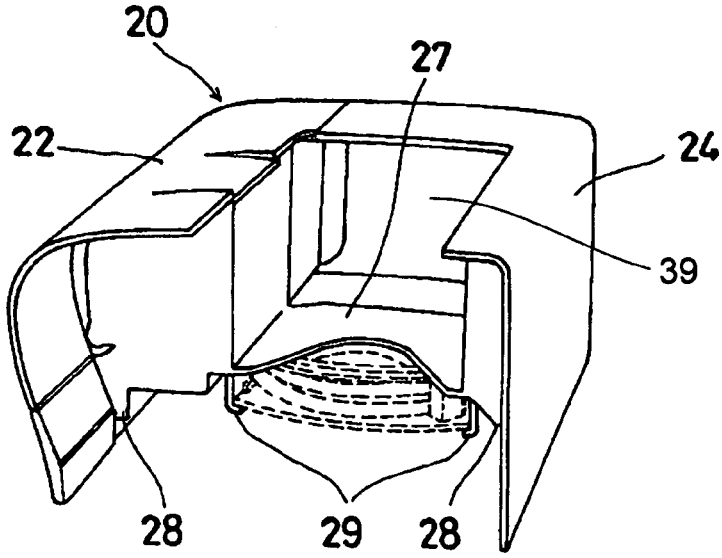
FIG. 6 is a perspective view of the auxiliary bed per se when its front portion is closed.
Figure 7:
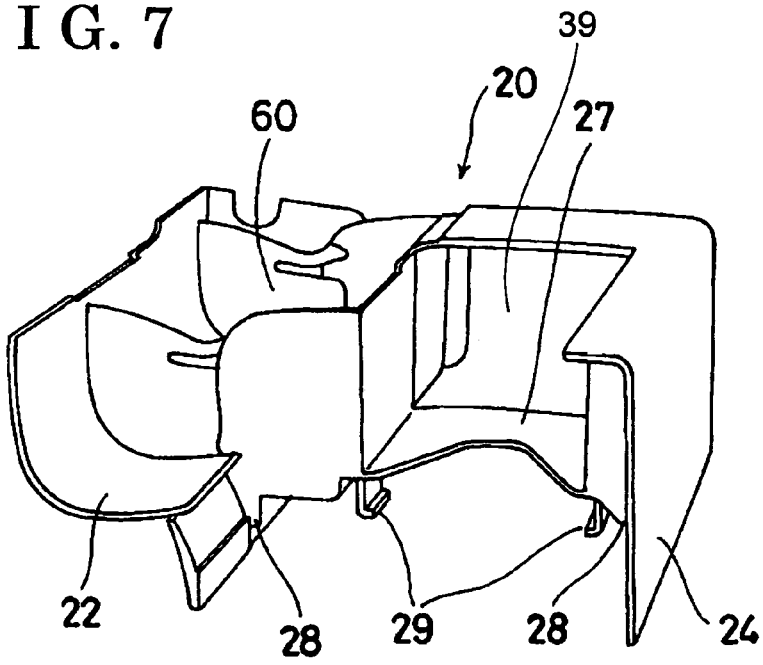
FIG. 7 is a perspective view of the auxiliary bed per se when its front portion is opened.
Figure 8:
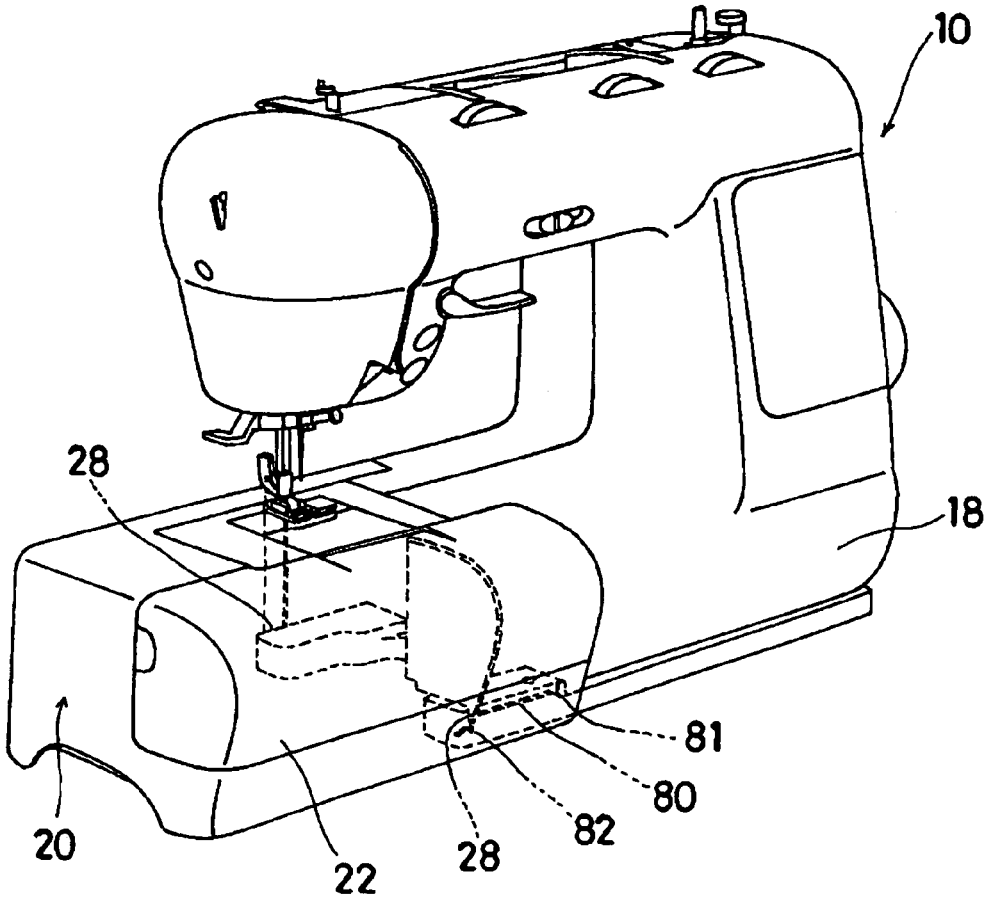
FIG. 8 is a perspective through-view of the sewing machine shown in FIG. 2 for illustrating an interior of a lower portion thereof.

With the configuration of the sewing machine 10 illustrated in FIG. 1, in a case where a normal workpiece is to be sewn, as shown in FIGS. 2–3, mounting an auxiliary bed 20 on the free arm portion 12, the working space of the sewing machine 10 is enlarged. In the condition illustrated in FIG. 2, the auxiliary bed 20 is mounted on the free arm portion 12 in such a manner that the resulting auxiliary bed 20 which allows the sewing machine 10 to operate and the free arm portion 12 cooperate to define a first working space. The first working area is defined by the free arm portion 12 and the auxiliary bed 20 in a stepped fashion when the auxiliary bed 20 is in overlap engagement with the free arm portion 12. In contrast, in the condition illustrated in FIG. 3, when the auxiliary bed 20 is moved through a predetermined distance in an extending direction of the free arm portion 12, the auxiliary bed 20 is brought into engagement with the free arm portion 12, resulting in that the auxiliary bed 20 is made being in flush or coplanar with the free arm portion 12 to form a flat bed which defines thereon a second working space larger than the first working space.

As illustrated in FIGS. 4–7, the auxiliary bed 20 includes a front portion 22, a rear portion 24, and an end portion 26. In a planar view, the auxiliary bed 20 is in the form of a substantially horseshoe shape. The front portion 22, the rear portion 24, and the end portion 26 of the auxiliary bed 20 define a slot 39 and the end portion 26 serves as a closed surface. Assembling of the auxiliary bed 20 onto the free arm portion 12 is achieved by causing the auxiliary bed 20 to move in a right hand direction, as viewed in FIG. 4, and causing it to engagingly fit onto the free arm portion 12. More particularly, when the free arm portion 12 has been completely inserted into the slot 39 of the auxiliary bed 20, and the end portion 26 of the auxiliary bed 20 ends up on an end surface of the free arm portion 12, the condition illustrated in FIG. 2 is established. Further, the auxiliary bed 20 is provided with an accessory case 60 (i.e., storage portion) at a rear side of the front portion 22, and the auxiliary bed 20 is capable of housing a foot controller between a bottom plate 27 of the auxiliary bed 20 and a supporting member 29.

A pair of projecting portions 80 (i.e., elastic portion) is extended from a lower portion of the sewing machine body 18 in a cantilever condition so as to be parallel with the free arm portion 12. Each one of the projecting portions 80 is formed with a root side recess portion 81 and an end side recess portion 82. As long as the auxiliary bed 20 is not detached from the free arm portion 12, the projecting portions 80 are in elastic contact with lower protrusions 28 (i.e., protrusion) of the auxiliary bed 20. Accordingly, when the auxiliary bed 20 is in the condition illustrated in FIG. 2, the lower protrusions 28 of the auxiliary bed 20 fit into the root side recess portions 81 of the projecting portions 80, and the auxiliary bed 20 is thereby maintained stably in a housing position.

When the auxiliary bed 20 is pulled away from the condition illustrated in FIG. 2 to the condition illustrated in FIG. 3, the lower protrusions 28 of the auxiliary bed 20 slide along the projecting portions 80 and engagingly fit into the end side recess portions 82 of the projecting portions 80. Engagingly fitting in this fashion prevents the auxiliary bed 20 from moving more than a predetermined distance, and both the lower protrusions 28 and the projecting portions 80 serve as stoppers.

According to the embodiment of the present invention, causing the auxiliary bed to move a predetermined distance along an extending direction of the free arm portion, enables a flat bed portion to be formed that is capable of enlarging a working space for sewing, by causing the auxiliary bed to cooperate in a flush condition with the free arm portion. With the configuration of the sewing machine according to the present invention, the working space for sewing, without difficulty, can be enlarged, and the utility of the sewing machine can be enhanced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sewing machine comprising:

a sewing machine body;

a free arm portion extending from the sewing machine body; and an auxiliary bed detachably mounted on the free arm portion to allow the sewing machine to operate, the auxiliary bed cooperating with the free arm portion to define a stepped first working area when the auxiliary bed is in overlap engagement with the free arm portion, the auxiliary bed cooperating with the free arm portion to define a second working area which is larger than the first working area when the auxiliary bed is brought into flush engagement with the free arm portion.

2. The sewing machine according to claim 1, further comprising:

a stopper positioned between the sewing machine body and the auxiliary bed for preventing the auxiliary bed from moving more than the predetermined distance, wherein immediately when the stopper prevents the auxiliary bed from moving, the auxiliary bed engagingly fits onto the free arm portion so as to establish the flush engagement with the free arm.

3. The sewing machine according to claim 2, wherein the stopper includes:

a protrusion provided at a lower portion of the auxiliary bed; and an elastic portion extending from the sewing machine body in a cantilever condition so as to be parallel to the free arm portion, and integrally formed with a recess portion, into which the protrusion is inserted when the auxiliary bed is moved the predetermined distance.

4. The sewing machine according to claim 3, wherein the elastic portion is normally elastically in contact with the protrusion.

5. The sewing machine according to claim 1, wherein the auxiliary bed includes in its interior a storage portion.

6. The sewing machine according to claim 5, wherein the storage portion opens from a side opposite to the free arm portion.

7. The sewing machine according to claim 1, wherein the auxiliary bed is made of resin.

8. A sewing machine comprising:

a sewing machine body;

a free arm portion extending from the sewing machine body; and an auxiliary bed detachably mounted on the free arm portion to allow the sewing machine to operate, the auxiliary bed being slidable along the free arm portion to cooperate therewith for defining at least first and second working areas, the first working area being defined in stepped fashion when the auxiliary bed is in overlap engagement with the free arm portion, the second working area being larger than the first working area and being defined when the auxiliary bed is brought into flush engagement with the free arm portion from a position at which the auxiliary bed cooperates with the free arm portion to define the first working area.

9. The sewing machine according to claim 8, further comprising a stopper positioned between the sewing machine body and the auxiliary bed for regulating the sliding movement of the auxiliary bed along the free arm portion within a predetermined distance when the first working area is expanded to the second working area.

10. The sewing machine according to claim 9, wherein the stopper includes:

a protrusion provided at a lower portion of the auxiliary bed; and an elastic portion extending from the sewing machine body in a cantilever condition so as to be parallel to the free arm portion, and integrally formed with a recess portion into which the protrusion is inserted when the auxiliary bed is slid the predetermined distance.

11. The sewing machine according to claim 10, wherein the elastic portion is normally elastically in contact with the protrusion.

12. The sewing machine according to claim 8, wherein the auxiliary bed includes in its interior a storage portion.

13. The sewing machine according to claim 12, wherein the storage portion opens from a side opposite to the free arm portion.

14. The sewing machine according to claim 1, wherein the auxiliary bed is made of resin.

* * * * *